US007290534B2

(12) United States Patent
Fischer

(10) Patent No.: US 7,290,534 B2
(45) Date of Patent: Nov. 6, 2007

(54) INJECTOR LEAKAGE LIMITATION

(75) Inventor: Kjell Fischer, Göteborg (SE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/684,670

(22) Filed: Mar. 12, 2007

(65) Prior Publication Data

US 2007/0144489 A1 Jun. 28, 2007

(51) Int. Cl.
*F02M 37/10* (2006.01)
*F02M 37/04* (2006.01)

(52) U.S. Cl. ..... 123/509; 123/519

(58) Field of Classification Search ..... 123/509, 123/511, 512, 516, 518, 447, 520, 495, 497, 123/456, 519
See application file for complete search history.

(56) References Cited

U.S. PATENT DOCUMENTS

| | | | | |
|---|---|---|---|---|
| 3,731,665 | A | 5/1973 | Garcea | |
| 4,732,131 | A * | 3/1988 | Hensel | 123/516 |
| 5,245,974 | A * | 9/1993 | Watson et al. | 123/518 |
| 5,390,643 | A * | 2/1995 | Sekine | 123/514 |
| 5,398,655 | A * | 3/1995 | Tuckey | 123/456 |
| 5,701,869 | A * | 12/1997 | Richardson et al. | 123/497 |
| 5,711,275 | A * | 1/1998 | Minagawa et al. | 123/458 |
| 5,791,317 | A * | 8/1998 | Eck | 123/510 |
| 5,967,120 | A * | 10/1999 | Blanton et al. | 123/467 |
| 6,438,486 | B1 | 8/2002 | Mancini | |
| 6,446,618 | B1 * | 9/2002 | Hill | 123/698 |
| 6,532,941 | B2 * | 3/2003 | Begley et al. | 123/497 |
| 6,622,707 | B2 * | 9/2003 | Begley et al. | 123/497 |
| 6,679,228 | B1 | 1/2004 | Confer | |
| 6,772,738 | B2 * | 8/2004 | Rembold et al. | 123/514 |
| 6,988,488 | B2 * | 1/2006 | Pursifull et al. | 123/467 |
| 7,066,152 | B2 * | 6/2006 | Stroia et al. | 123/467 |
| 2002/0020397 | A1 | 2/2002 | Begley et al. | |
| 2002/0043253 | A1 * | 4/2002 | Begley et al. | 123/497 |
| 2004/0055580 | A1 * | 3/2004 | Yamada et al. | 123/495 |
| 2004/0206338 | A1 | 10/2004 | Pursifull et al. | |
| 2006/0048752 | A1 * | 3/2006 | Stroia et al. | 123/458 |
| 2006/0231079 | A1 * | 10/2006 | Paluszewski | 123/514 |

FOREIGN PATENT DOCUMENTS

| | | | |
|---|---|---|---|
| EP | 0836872 | A | 3/1998 |

* cited by examiner

*Primary Examiner*—Mahmoud Gimie
(74) *Attorney, Agent, or Firm*—Diana D Brehob

(57) ABSTRACT

A fuel supply system (100) for a combustion engine (180) has at least one fuel injector (110), a fuel pump (130) and a conduit (150) connecting the fuel pump (130) with the fuel injector (110). An air intake valve (160) connects the conduit (150) to the atmosphere. The air intake valve (160) is a one-way valve that prevents sub-atmospheric pressures in the conduit (150) by allowing air to enter the conduit (150) when the pressure in the conduit (140) is lower than atmospheric pressure.

12 Claims, 1 Drawing Sheet

INJECTOR LEAKAGE LIMITATION

FIELD OF THE INVENTION

The present invention relates to a fuel supply system for a combustion engine having at least one fuel injector, a fuel pump and conduit connecting said fuel pump with said at least one fuel injector.

PRIOR ART

Fuel injection systems for gasoline engines have been commonly used since the early nineteen seventies, particularly since electronically controlled fuel injection allows the precise air-fuel control needed for obtaining high conversion efficiency from three-way catalysts.

On early electronic fuel injection systems, a separate fuel pump connecting the fuel tank and a common manifold for the fuel injectors was used. The fuel pump was powered with a constant voltage supply that was sufficient to deliver all fuel necessary for the engine at full load. At low and medium loads, the surplus fuel was led back to the fuel tank via a pressure control valve, which kept the fuel pressure in the fuel rail constant. The amount of fuel injected to the engine was controlled by the time the injectors were opened, commonly called pulse width modulation.

There were, however, some drawbacks with the above-mentioned system. First, a fuel return conduit returned the excess fuel to return to the fuel tank, which necessitates a return line. An undesired side effect of circulating the extra fuel through the system is that the fuel is heated during its contact with the warm engine and by the pressurization/depressurization cycles. Second, it was difficult to vary the fuel pressure which limits the dynamic range of the fuel supply system.

More recently, fuel supply systems without return conduits have gained wide-spread use to allow for an increase of injection dynamic range, elimination of the fuel return conduit, and avoiding overheating of fuel.

Further, electronically controlled fuel pumps which allow control of fuel flow and fuel pressure by changing the electrical power to the fuel pump are available.

Fuel pressure is maintained when the engine is turned off to prevent the fuel in the conduits, fuel injectors, and fuel rail near the engine from boiling by the heat from the engine. In normal operation, the fuel flows through the line to the engine and has insufficient time to boil prior to being injected. If vapor forms in the system, a subsequent start of the engine is delayed or impossible. To maintain pressure in the system there is a one-way valve, commonly placed in the fuel pump. This one-way valve makes the fuel system a closed fuel volume. To limit the pressure in the system, in case of for example volume expansion due to temperature increase, a pressure relief valve is also installed in the system letting the fuel back to the tank. For mechanically controlled fuel systems, the pressure control valve works as the pressure-limiting valve when the pump is not running. In electronically controlled fuel systems in which system pressure can be varied, a similar valve is installed but mostly at a higher set point than the highest operating pressures for the fuel systems to avoid having the valve opening and closing giving wear problems and transient problems when operating the fuel pump and the engine.

The principal design described above will keep the pressure during the whole heating sequence of the fuel in the system. When the system is subsequently cooled down, the pressure decreases as a result of the cooling contraction.

When the pressure becomes less than atmospheric, the one-way valve will open and fuel is sucked into the system from the tank.

Repeated diurnal temperature changes, as in temperature variations between day and night, lead to changes of over and under pressure. Fuel is sucked into the system as a consequence.

During overpressure in the fuel system, the injectors may leak. The fuel leaked through injectors may migrate through the air intake system and end up in the atmosphere, thus increasing HC pollution of the environment. The problem is accentuated if the car is parked for a long time in a place with large temperature variations between day and night; in such a case, the internal fuel volume will work as a pump, and draw in fuel from the fuel tank during the night, and expel that fuel through the injectors and the relief valve during daytime when the temperature is high. In U.S. Pat. No. 3,731,665, a system for reducing fuel vapor emissions has a conduit connecting the fuel tank and the engine crankcase. Since the crankcase is vented to the engine induction system, fuel vapor from the tank will eventually end up in the combustion chambers of the engine, and take place in the combustion.

U.S. Pat. No. 6,438,486 describes another system having a fuel vapor absorber placed upstream of the fuel injectors, in the intake air stream, which prevents fuel migration from the fuel injectors to the atmosphere. U.S. Pat. No. 6,438,486 does not discuss reducing fuel leakage from the injectors, only a method to stop the migration of fuel from the fuel injectors to the atmosphere.

U.S. Pat. No. 6,679,228, which describes yet another system for reducing migration of fuel vapors from the fuel injectors to the atmosphere, also fails to teach how to reduce fuel leakage from the fuel injectors.

U.S. Pat. Nos. 6,679,228 and 6,438,486 are directed towards fuel injection systems. Consequently, the content of these documents is mentioned in the preamble of independent claim 1.

SUMMARY OF THE INVENTION

The present invention solves the above-mentioned and other problems by providing a gas intake valve connecting a fuel conduit to the atmosphere. The gas intake valve is a one-way valve that prevents sub-atmospheric pressures in the fuel conduit by allowing fuel to enter the fuel conduit.

BRIEF DESCRIPTION OF THE DRAWING

In the following, the invention will be described with reference to the single drawing, which is a schematic view of a fuel supply system having the gas intake valve according to the invention.

DETAILED DESCRIPTION

Figure 1:
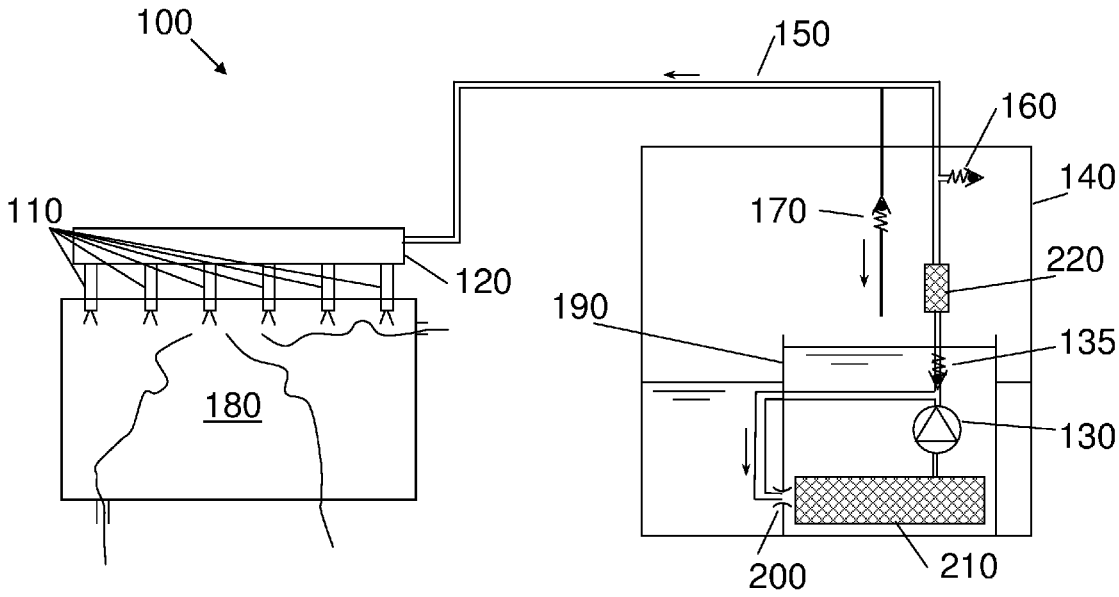

In FIG. 1, a fuel supply system 100 having six fuel injectors 110 connected to a fuel rail 120 is shown. Fuel injectors 110 supply to fuel to engine 180. Fuel rail 120 is connected to a fuel pump 130, situated in a fuel tank 140, via a conduit 150. Fuel pump 130 has a one-way valve 135, which prevents fuel from flowing from the fuel rail 120 and conduit 150 to the tank 140 when the fuel pump 130 is shut off. An air intake valve 160, of the one-way type is connected to conduit 150. And a pressure relief valve 170 is connected to conduit 150. Fuel tank 140 is supplied a fuel supply tank 190 with a level keeping ejector pump 200 providing communication between tanks 140 and 190. A pre-filter 210 filters the fuel prior to entering fuel pump 130. Main filter 220 filters the fuel prior fuel entering fuel injectors 110.

As engine 180 is shut off, pressurized fuel remains in fuel rail 120. This fuel expands, due to being in close proximity to a hot engine; pressure in the fuel supply system 100 increases. When the pressure exceeds the setpoint pressure of pressure relief valve 170, it opens allowing fuel to be released into fuel tank 140. As the engine and fuel supply system cool down, pressure in the fuel supply system decreases. As pressure drops below atmospheric pressure, the air intake valve 160 opens, allowing air into the fuel supply system. Those skilled in the art recognize that the air that is drawn into through air intake valve 160 contains fuel vapor when the air intake valve 160 opens within fuel tank 140.

With a small amount of air in the fuel supply system, a subsequent temperature increase compresses the air, with a rather smaller pressure rise, rather than allowing the incompressible fuel in the line to rise to a higher pressure which would allow fuel to leak through the injectors. By having a small amount of air in the system, the fuel injectors are exposed to very small positive and negative fuel pressures, which are too small to allow significant fuel injector leakage.

In the described embodiment, the air inlet valve 140 opens in the fuel tank. For air to be inducted into the air inlet valve, the level of this valve should be lower than the fuel level in the tank. In FIG. 1, air inlet valve 160 is placed near the top of the tank. Alternatively, air inlet valve is placed outside fuel tank 140.

The opening pressure of air intake valve 160 is lower than the opening pressure of one-way valve 135. If this were not so, the fuel may be drawn in through one-way valve 135 and fuel pump 130 from fuel tank 140.

The invention has been explained for an engine with six cylinders. It is however obvious for a person skilled in the art that the invention could be successfully implemented on engines having another number of cylinders, e.g. one, two, three, four, five, six, eight, ten, twelve or eighteen cylinders.

I claim:

1. A fuel supply system (100) for a combustion engine (180), comprising:

at least one fuel injector (110);

a fuel pump (130);

a conduit (150) for conducting liquid fuel connecting said fuel pump (130) with said at least one fuel injector (110); and an air intake valve (160) connecting said conduit (150) to the atmospheric pressure, said air intake valve (160) being a one-way valve.

2. The fuel supply system (100) of claim 1 wherein said air intake valve (160) prohibits sub-atmospheric pressures in said conduit (150) by allowing gas to enter said conduit (150) in case the pressure in said conduit (140) is lower than the atmospheric pressure.

3. The fuel supply system (100) of claim 1, further comprising:

a fuel tank (140) wherein said air intake valve (160) opens to said fuel tank (140).

4. The fuel supply system (100) of claim 1 wherein said air intake valve (160) opens to the atmosphere.

5. The fuel supply system (100) of claim 1, further comprising:

a fuel supply tank (190) disposed within said fuel tank (140); and a fuel ejector pump disposed in an opening between said fuel supply tank (190) and said fuel tank (140).

6. The fuel supply system (10) of claim 1, further comprising:

a pressure relief valve disposed in a line between said conduit (150) and said fuel tank (140).

7. A fuel supply system (100) for an internal combustion engine (180), comprising:

a fuel tank (140);

a fuel pump (130) disposed within said fuel tank (140);

a fuel rail (120);

a conduit (150) between said fuel pump (130) and said fuel rail (120); and a gas intake valve (160) coupled to said conduit (150).

8. The system (100) of claim 7 wherein said gas intake valve (160) is a one-way valve allowing gases to enter said conduit (150) and preventing fuel from leaving through said gas intake valve (160).

9. The system (100) of claim 7 wherein said gas intake valve (160) is disposed within said fuel tank (140).

10. The system (100) of claim 7 wherein said gas intake valve (160) is outside of said fuel tank (140).

11. The system (100) of claim 7, further comprising:

a fuel supply tank (190) disposed within said fuel tank (140); and a fuel ejector pump disposed in an opening between said fuel supply tank (190) and said fuel tank (140).

12. The system (100) of claim 7, further comprising:

a fuel rail (120) coupled to said conduit (150); and fuel injectors (110) coupled to said fuel rail (120), said fuel injectors (110) supplying fuel to the internal combustion engine (180).

* * * * *